US005984745A

United States Patent [19]

Ruigrok et al.

[11] Patent Number: 5,984,745

[45] Date of Patent: Nov. 16, 1999

[54] METHOD OF MANUFACTURING A MAGNETIC DEVICE

[75] Inventors: Jacobus J. M. Ruigrok; Marinus L. A. Vrinten; André A. Verhulst; Casper M. Smit, all of Eindhoven, Netherlands

[73] Assignee: U.S. Philips Corporation, New York, N.Y.

[21] Appl. No.: 09/103,458

[22] Filed: Jun. 24, 1998

[30] Foreign Application Priority Data

Aug. 4, 1997 [EP] European Pat. Off. ..... 97202429

[51] Int. Cl.[6] ..... H01J 9/42

[52] U.S. Cl. ..... 445/3

[58] Field of Search ..... 445/3 B, 1

[56] References Cited

U.S. PATENT DOCUMENTS 4,578,661 3/1986 Van Rijsewijk et al. ..... 335/212

4,662,853 5/1987 Van Veldhoven ..... 445/3

4,669,994 6/1987 Van Der Wilk ..... 445/3

FOREIGN PATENT DOCUMENTS 2000635 1/1979 United Kingdom .

*Primary Examiner*—Kenneth J. Ramsey

*Attorney, Agent, or Firm*—Robert J. Kraus

[57] ABSTRACT

An element of an apparatus is magnetized so as to generate a magnetic field pattern around the element. To achieve this, use is made of a magnetizing coil, and the element and the magnetizing coil are moved relative to each other, the magnetizing coil carrying an alternating current of substantially constant amplitude as well as a signal current. Preferably, there is a phase difference between the signal current and an intended magnetic field pattern.

7 Claims, 8 Drawing Sheets

METHOD OF MANUFACTURING A MAGNETIC DEVICE

DESCRIPTION

The invention relates to a method of manufacturing a device comprising an element of a hard-magnetic material, which method includes a step in which the element is magnetized by means of one or more magnetizing coils to generate a magnetic field pattern.

Examples of devices which may comprise an element of a hard-magnetic material generating a magnetic field pattern include, inter alia, cathode ray tubes, for example cathode ray tubes in display devices or in oscilloscopes, electron microscopes and NMR (nuclear magnetic resonance) devices.

A method of the type mentioned in the opening paragraph is known from British patent application GB 2 000 635 A.

In GB 2 000 635, a method of manufacturing a device, in this case a cathode ray tube for a display device, is described in which an annular element is magnetized by a coil system comprising a number of coils arranged near said annular element. The cathode ray tube comprises an electron gun for generating three electron beams, a display screen and a deflection unit for deflecting the electron beams across the display screen. The magnetic field pattern generated by the magnetized element influences the electron beams on their way from the electron gun to the display screen. By virtue thereof, errors relating to the form, position or landing angle of the electron beams on the screen can be corrected. This is achieved by magnetizing the element in dependence upon errors observed in the picture display. Magnetization of the element takes place by supplying a signal current to one or more coils of the coil system, while simultaneously supplying a decreasing alternating current to the coils of the coil system.

However, the known method has a number of drawbacks. The coil system used for magnetizing has a relatively high energy consumption and takes up much space.

The possibilities of influencing the electron beams were found to be limited in practice. Correction of errors leads to the introduction of new errors, which are smaller but very difficult, or even impossible, to correct.

It is an object of the invention to provide a method which reduces one or more of said drawbacks.

To achieve this, the method in accordance with the invention is characterized in that the magnetizing coil(s) and the element move relative to each other during magnetization of the element, while an alternating current of substantially constant amplitude as well as a signal current are passed through the magnetizing coil(s).

The method in accordance with the invention generally requires less energy and is more accurate, i.e. the accuracy with which the magnetic field generated by the element can be made to correspond with an intended field is greater.

An element magnetized in accordance with the state of the art generates a magnetic field exhibiting undesirable higher-order components. These higher-order components are caused around the positions of the edges of the coils of the magnetizing coils during magnetizing and/or around the edges of discrete magnetic elements and/or by inhomogeneities in the element. These higher-order components can be reduced in the known method by increasing the distance between the magnetizing coils and the element, however, this creases the consumption of energy.

The relative movement of the magnetizing coil(s) and the element as well as the way in which the element is magnetized in the method in accordance with the invention causes the occurrence of such undesirable higher-order components in the magnetic field pattern to be reduced. This leads to a greater accuracy in the magnetic field pattern.

The relative movement and the supply of the alternating current (with which a relatively rapidly changing magnetic bias field is created) and one or more signal currents to the magnetizing coil(s) causes edge effects to be reduced. Said edge effects (which, in the prior art, occur, for example, around the edges of the magnetizing coils or around the edges of discrete elements) are partly responsible for undesirable higher-order components in the magnetic field pattern near the element.

The magnetizing process requires less energy because the volume of the magnetizing coils is generally smaller. Instead of, for example, 8 magnetizing coils, as used in the prior art, fewer coils, for example 1 or 2, are sufficient. Preferably, only one magnetizing coil is used.

The invention can very suitably be used for a cathode ray tube comprising a means for generating an electron beam (for example an electron gun), said electron beam moving through the magnetic field pattern of the element, during operation.

Inaccuracies in the magnetic field pattern adversely affect the shape and the position of the electron beam.

As regards a cathode ray tube which comprises a means for deflecting the electron beam and in which the position of the electron beam in the magnetic field pattern is governed, during operation, by the deflection of the electron beam, precluding or reducing inaccuracies in the magnetic field pattern is particularly important.

If the position of the electron beam (or beams if more than one electron beam is generated) in the magnetic field pattern is dependent on the deflection of the electron beam(s), then the errors caused by inaccuracies in the magnetic field pattern are dependent on the deflection (i.e. position-dependent). Correction of these dynamic errors is more difficult than correction of errors which are constant, that is, static errors.

Preferably, the element and the magnetizing coil(s) are moved relative to each other in such a manner that at least a part of the element is magnetized twice in one movement.

As a result, at least a part of the element is "overwritten", i.e. magnetized twice. Sudden transitions in the magnetic field pattern are thereby avoided or reduced.

In these embodiments preferably results in a reduction in amplitude of the alternating current and the signal current occurs, while the relative movement of the coil(s) and the element is continued.

By reducing the amplitude of said currents, while the relative movement of the coil(s) and the element is continued, it is precluded that the magnetization of the element exhibits sudden transitions. These transitions cause inaccuracies, in particular higher-order components, in the magnetic field pattern.

These and other aspects of the invention will be apparent from and elucidated with reference to the embodiments described hereinafter.

IN THE DRAWINGS

The Figures are not drawn to scale. In the Figures, like reference numerals generally refer to like parts.

Figure 1:
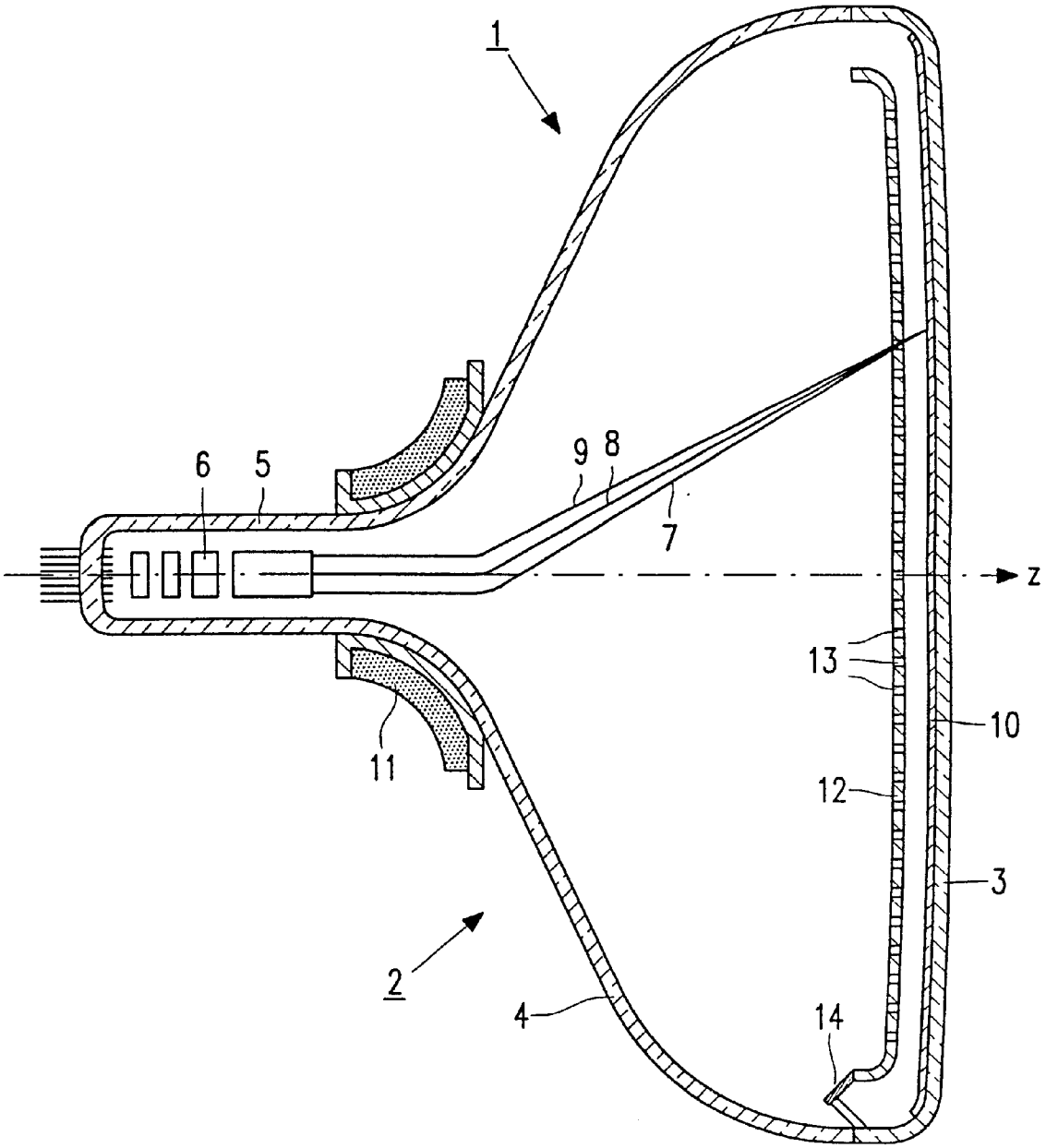
FIG. 1 shows a display device.

A color display device 1 (FIG. 1) incorporates an evacuated envelope 2 comprising a display window 3, a cone portion 4 and a neck 5. Said neck 5 accommodates an electron gun 6 for generating three electron beams 7, 8 and 9. A display screen 10 is provided on the inside of the display window. Said display screen 10 comprises a phosphor pattern of phosphor elements luminescing in red, green and blue. On their way to the display screen, the electron beams 7, 8 and 9 are deflected across the display screen 10 by means of deflection unit 11 and pass through a shadow mask 12 which is arranged in front of the display window 3 and which comprises a thin plate having apertures 13. The shadow mask is suspended in the display window by means of suspension means 14. The three electron beams converge and pass through the apertures of the shadow mask at a small angle with respect to each other and, consequently, each electron beam impinges only on phosphor elements of one color.

Figure 2:
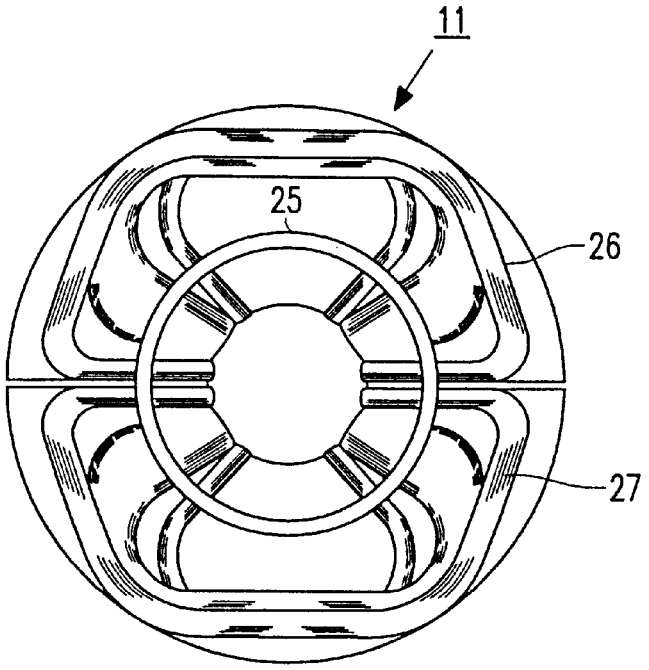
FIG. 2 is a front view of a deflection unit provided with an annular magnetized element.
Figure 3:
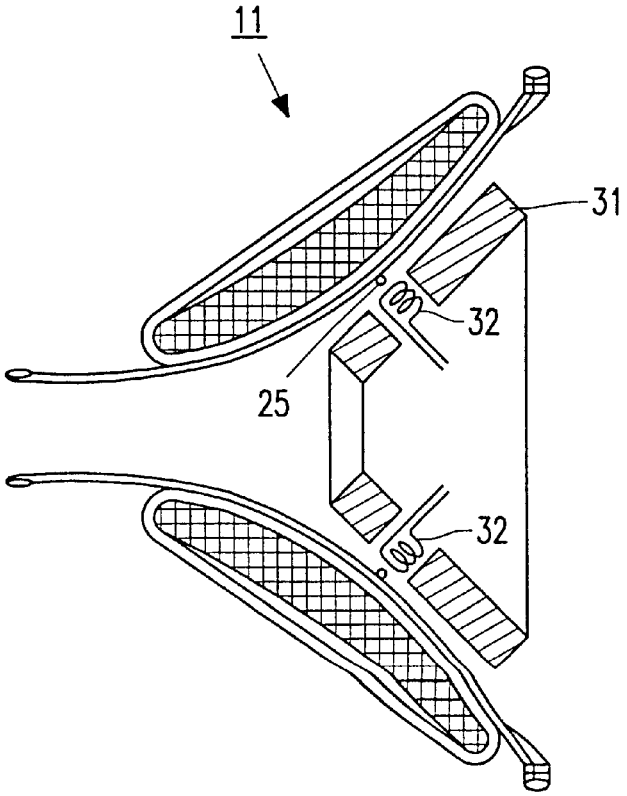
FIG. 3 illustrates the known method.

FIG. 2 is a front view, i.e. viewed from the screen, of a deflection unit 11. The deflection unit 11 is provided on the inside with two deflection coils 26 and 27 and an annular magnetizable element 25. In the method in accordance with the state of the art, the element 25 is magnetized by means of a magnetizing coil system 31 incorporating a number of magnetizing coils 32, as schematically shown in FIG. 3.

The coils generate a magnetic field by which the element 25 is magnetized. The element 25 generates a magnetic field by means of which the shape and the path of the electron beams is influenced during operation.

Figure 4:
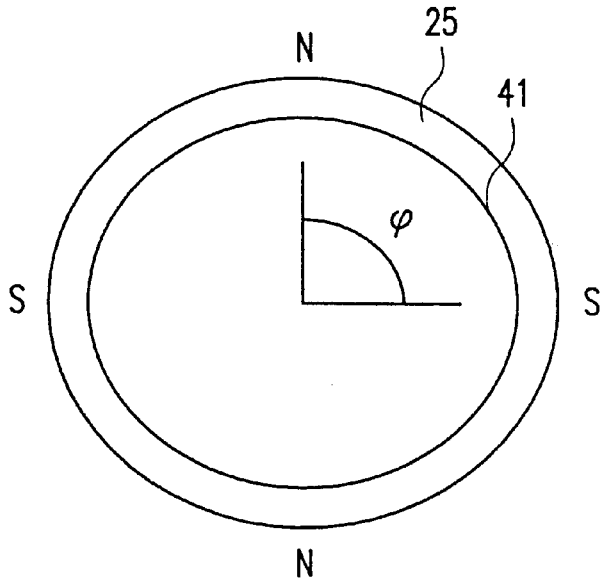
FIGS. 4 and 5 illustrate the magnetic field pattern of a magnetic element in a device manufactured in accordance with the known method.
Figure 5:
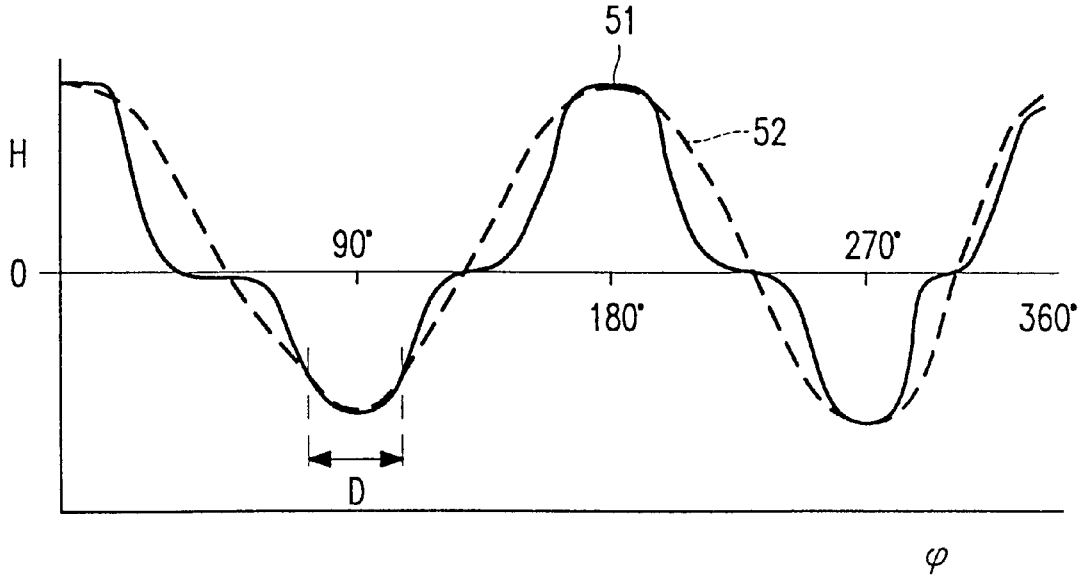

FIGS. 4 and 5 illustrate the magnetic field pattern of an annular element 25 which is magnetized by four coils 32 arranged in the form of a cross. The element 25 has two north poles (N) and two south poles (S) (FIG. 4). The magnetic field H, whose strength at a short distance from the inner side 41 of the element 25 is indicated, as a function of the angle $\phi$, by line 51 in FIG. 5, exhibits two maximum and minimum values having a width D which corresponds approximately to the size of the coils 32. The field strength between the maxima and the minima is approximately zero. Thus, the magnetic field H has a four-pole component. However, in addition to the four-pole component, the magnetic field includes higher-order components, namely 12-pole, 20-pole and 28-pole components. The interrupted line 52 schematically indicates a four-pole field. The difference between the lines 51 and 52 forms a field which comprises a 12-pole component and said higher-order components. In other words, apart from a four-pole component, the field pattern 51 also comprises a 12-pole component and higher-order components. The strength and the size of the higher-order components cannot be selected at will but are determined by the method employed. The strength of the 12-pole component can be reduced by enlarging the coils 32 or by arranging said coils at a greater distance from the element 25, however, this takes up space and involves the consumption of energy. The strength of higher-order multipoles generally exhibits a stronger decrease, as a function of the distance to the element 25, than the strength of lower-order multipoles. Precluding undesirable higher-order multipoles is more important as the accuracy of the field pattern close to the element becomes more important. This matters, in particular, if the electron beam is deflected and, thus, the distance between the beam and the element is governed by said deflection.

Figure 6:
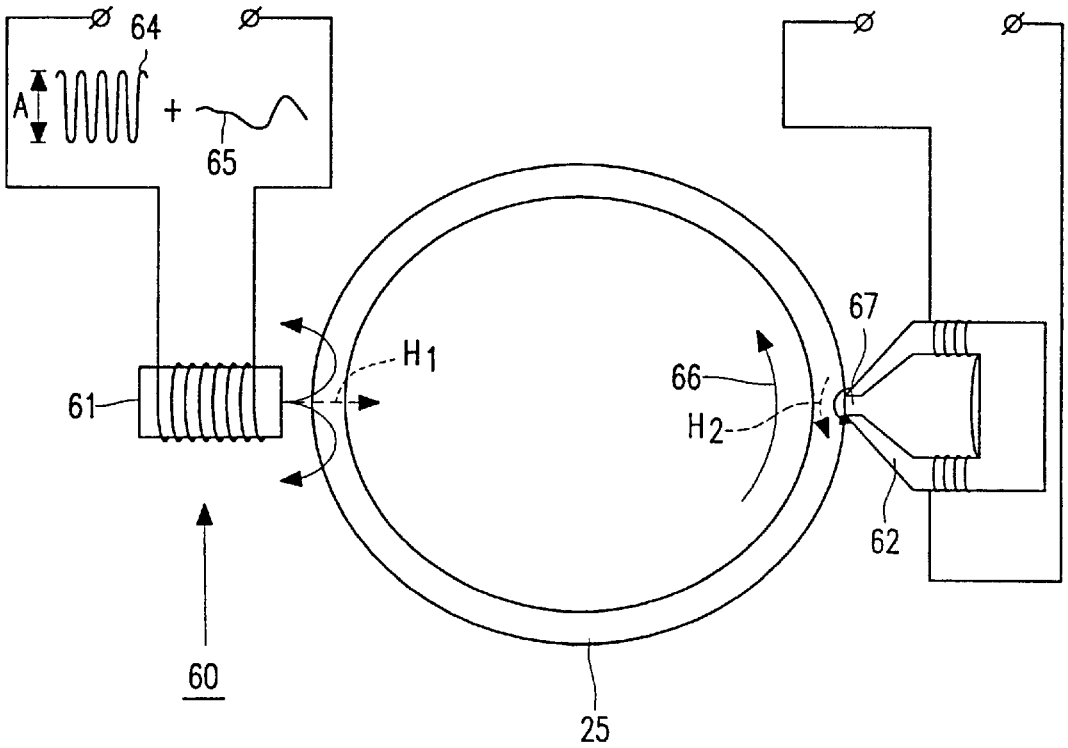
FIG. 6 illustrates an embodiment of the method in accordance with the invention.

FIG. 6 illustrates two embodiments of the method in accordance with the invention.

In a first embodiment, a coil 60 having a core 61 is energized by an alternating current 64 having a constant amplitude A (a bias current) and by a signal current 65. At the same time, the annular element 25 is rotated, as schematically indicated in the Figure by an arrow 66. The coil generates a magnetic field H1 which extends predominantly at right angles to the annulus. The magnetic field H1 causes the annular element 25 to be magnetized. The magnetization of the element 25 and hence the field pattern near the element is determined by the signal current 65 and the movement 66. The magnetizing coil system takes up less space than the known magnetizing coil system. By virtue of the relative movement of the coils and the manner in which said coils are energized, the magnetization of the element 25 can be accurately determined. A further advantage of the invention resides in that inhomogeneities in the material of the element (for example variations in thickness and/or composition of the element, scratches and/or fractures), which may also lead to undesirable components in the magnetic field generated by the element, can be satisfactorily compensated for. The inhomogeneities can be measured either by a separate measurement or by a measurement in which the coil 61 is used. As the system is linearized by the use of the bias signal 64, i.e. the strength of the magnetization of the element is governed approximately linearly by the strength of the signal current 65, the inhomogeneities can be compensated for in a simple manner in the signal current 65. Consequently, the disturbing effect of inhomogeneities can be readily compensated for. Even differences in thickness of 25% or more in the element can be compensated for by a suitable decrease or increase of the signal current and, consequently, said differences in thickness do not, or hardly, lead to deviations in the generated magnetic field (relative to an intended magnetic field). In the known static arrangement, the degree to which inhomogeneities can be compensated for is much smaller (only if the inhomogeneities occur in the vicinity of the coils).

The element 25 can also be magnetized by an electromagnet 62 having an air gap 67. Such an embodiment is depicted on the right-hand side of FIG. 6. Such a coil generates a magnetic field H2 which is directed predominantly along the element.

Preferably, the amplitudes of the alternating current 64 and the signal current 65 decrease during a last part of the magnetizing operation, while the movement of the coil and the element relative to each other is continued. By virtue thereof, edge effects in the vicinity of the end position(s) of the coil system are precluded (i.e. the position(s) where the coil(s) of the coil system is (are) situated upon termination of the magnetizing operation).

Preferably, the element is rotated through more than 360°. As a result, at least a part of the element 25 has been magnetized twice. This has the advantage that edge effects occurring at the beginning of the magnetization operation (for example in the vicinity of the edge of the core of coil 61) are overwritten.

FIG. 6 shows embodiments of the method in accordance with the invention, in which the coil system comprises one coil. The coil system may comprise a number of coils, for example two diametrically opposed coils which are each rotated, preferably, through slightly more than 180°. The signal supplied to the coils corresponds to the desired magnetization for the left-hand half or the right-hand half of the element 25.

Preferably, the signal current comprises components corresponding to components in an intended magnetic field pattern, the components of the signal current exhibiting a phase difference with respect to corresponding components of the magnetic field pattern which is suitable for an intended purpose. This is illustrated in FIGS. 7A through 7F.

The magnetization M in the element 25 brought about by a current I (see FIG. 7A) passing through the coil (60 or 62) includes a component which extends at right angles to the element 25 ($M_{||}(I)$) (see FIG. 7B) and a component which extends along element 25 (see FIG. 7C) ($M_{195}$ (I)). The ratio of the components $M_{195}$ and $M_{||}$ is governed by the strength of the magnetic fields (H1, H2) but is substantially constant for a large range of multipoles.

Figure 7A:
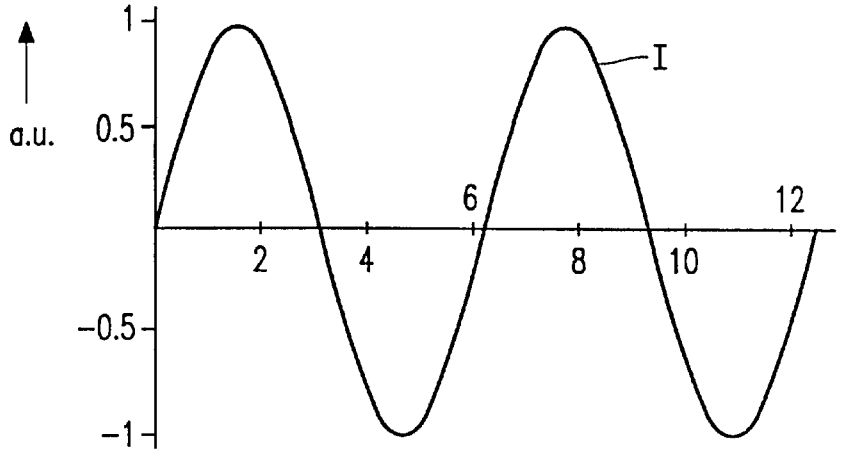
FIGS. 7A through 7F illustrate the relation between the signal current passing through a coil and the magnetization of, and magnetic fields around, in this example, an annular element.

FIG. 7A shows the strength I of a signal current 65 (the y-value) passing through coil 61, as a function of the position (the x-value) of coil 61 with respect to the annular element 25, expressed in radials relative to a starting position (0 radial) where the end point (4π) coincides with the starting point. The strength I of the signal current varies sinusoidally and exhibits two maxima and minima, i.e. two cycles. Such a variation in current enables a 4-pole field to be produced; a 6-pole field can be produced by means of a current exhibiting three cycles between the coinciding starting and end points; an 8-pole field can be produced by means of a current exhibiting 4 cycles, etc. The object is to generate a 4-pole magnetic field by means of this signal current I, which magnetic field exhibits a uniform trend, i.e. the initial strength is equal to zero and the field exhibits two maxima and two minima.

Figure 7B:
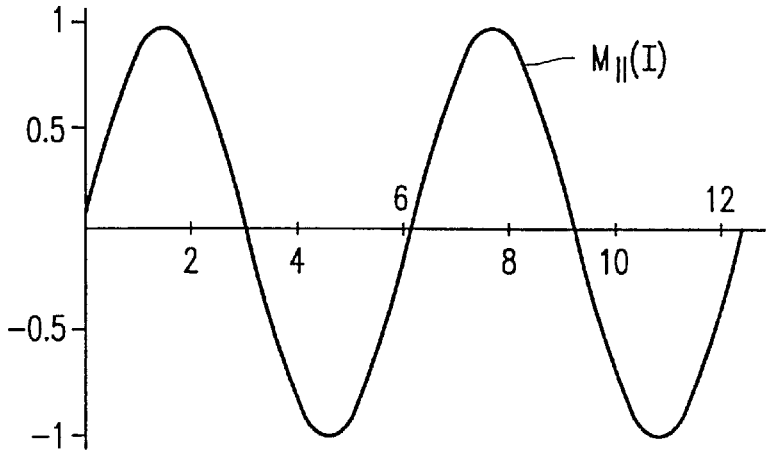
Figure 7C:
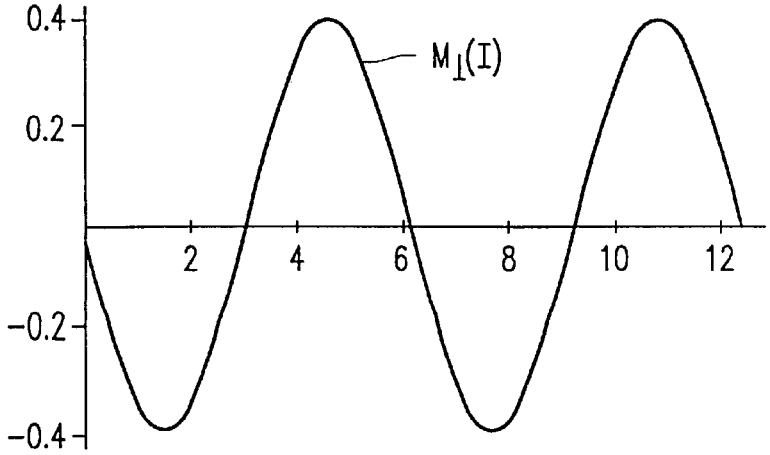
Figure 7D:
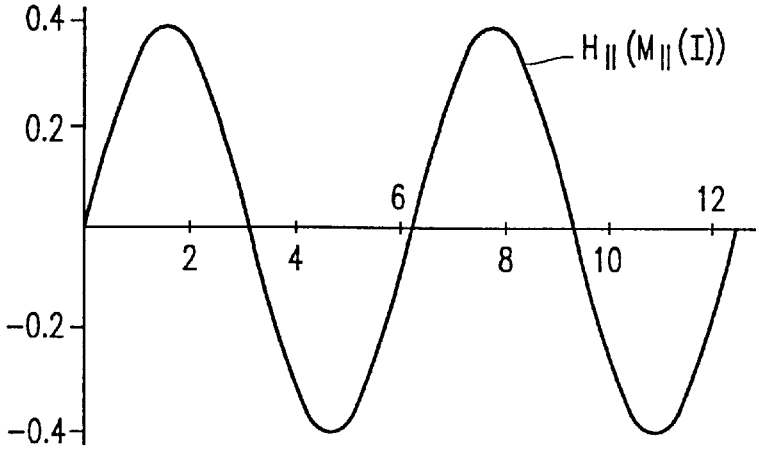
Figure 7E:
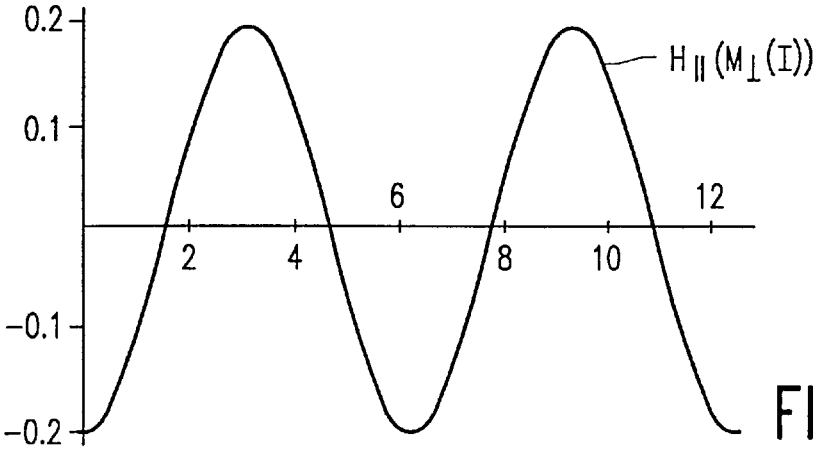

The current brings about magnetization of the element 25, so that both a magnetic component $M_{\perp}(I)$ and a magnetic component $M_{||}(I)$ are produced in the annular element. FIG. 7B shows the strength of $M_{||}(I)$ and FIG. 7C shows the strength of $M_{\perp}(I)$. Both components of the magnetization of element 25 cause a magnetic field having a longitudinal component $H_{||}$ in the immediate vicinity of element 25. FIG. 7D shows the magnetic field $H_{||}$ resulting from the magnetization $M_{||}(I)$ ($=H_{||}(M_{||}(I))$ and FIG. 7E shows the magnetic field $H_{||}$ caused by the magnetization $M_{\perp}(I)$ ($=H_{||}(M_{\perp}(I))$. The total longitudinal magnetic field component $H_{||}$ is equal to the sum of the two magnetic fields shown in FIGS. 7D and 7E, i.e.

ti $H_{||}(I)=H_{||}(M_{||}(I))+H_{||}(M_{\perp}(I))$

Figure 7F:
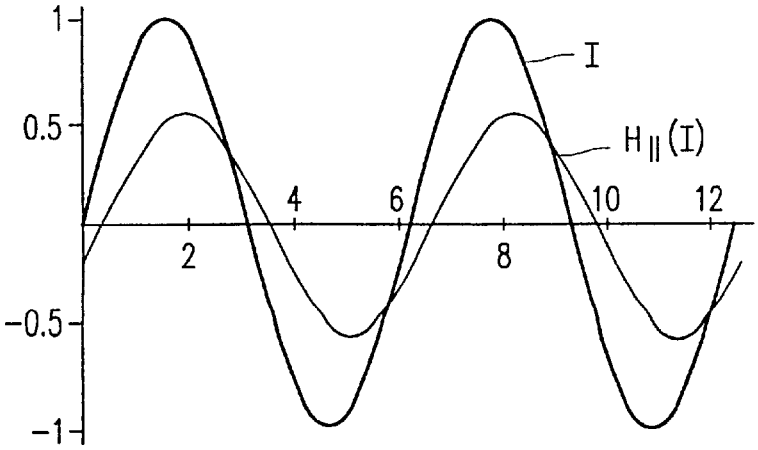

FIG. 7F shows both the current I and the field $H_{||}(I)$ brought about by the current I. FIG. 7F shows that there is a phase difference between the current I and the field $H_{||}(I)$. The peaks, valleys and zero-crossings of the magnetic field $H_{||}(I)$ are shifted by approximately 0.4 radial (which corresponds to approximately 22°) relative to the peaks, valleys and zero-crossings of the current I. Assuming that the intended field is synchronous to the current, i.e. the value of the intended field $H_{||}(I)$ is equal to zero at the starting point, it is obvious that the magnetic field $H_{||}(I)$ does not correspond to the intended field because the initial value of $H_{||}(I)$ is not equal to zero. If the magnetic field around the annulus is taken into consideration, it is found that the poles (the maxima and minima) are rotated relative to the poles of such an intended field. The inventors have recognized this effect and, in a preferred embodiment, there is a phase difference between the current and the intended magnetic field. In this example, a fairly simple magnetic field is produced which only comprises a 4-pole component. In the case of such a simple field, an effect similar to that obtained by a phase difference between the current and an intended field can be achieved by rotating the annulus after magnetization (in this example, the ring must be rotated through an angle of approximately 11°). In more general terms, this effect is achieved by displacing or moving the element. This is impossible if the intended field comprises a number of components (for example both 4-pole and 12-pole components), because the necessary shift of the element is different for the different components. For a 6-pole, 8-pole, 10-pole, etc., component the phase shift (the term "phase" is herein defined with respect to a sine of the signal) is approximately equal. For this reason, upon magnetizing the element 25, the signal current comprises components which correspond to components (two-pole, four-pole, six-pole, eight-pole, etc.) in the magnetic field pattern, the components of the signal current exhibiting a phase difference with respect to the corresponding components of the intended magnetic field pattern. This phase difference is governed by the ratio between the magnetizations $M_{\perp}$ and $M_{||}$.

Figure 8:
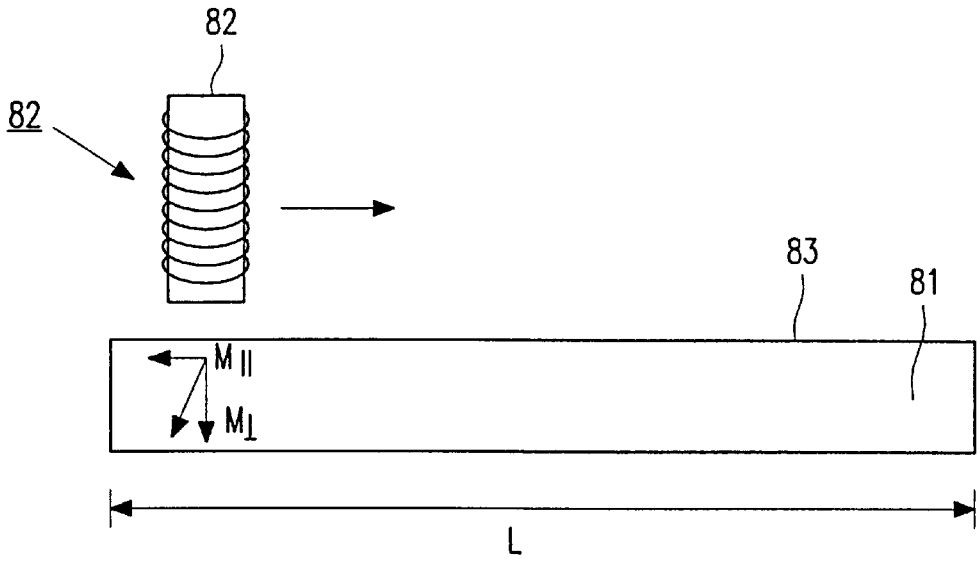
FIG. 8 illustrates the magnetization of a rod-shaped element.
Figure 9:
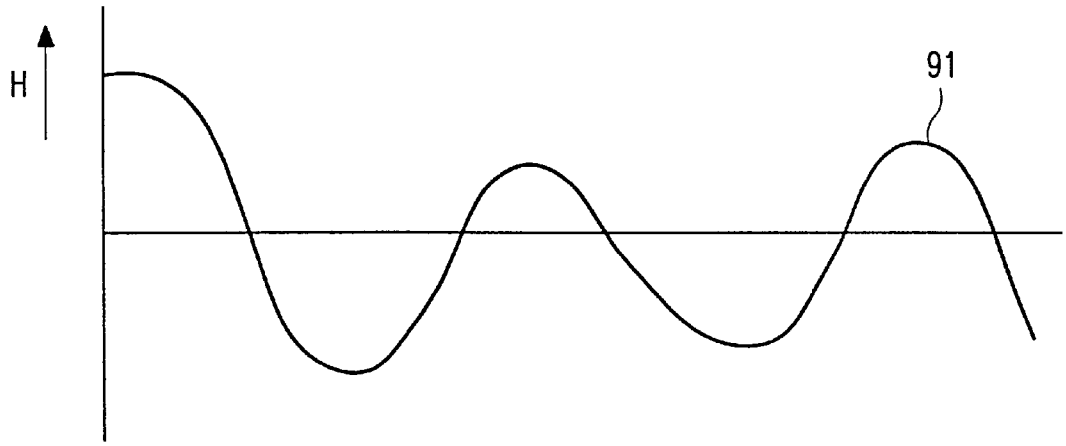
FIG. 9 shows the magnetic field around the rod-shaped element.

FIG. 8 schematically shows an elongated element 81 along which a coil 82 is moved to magnetize the element. FIG. 9 schematically shows an intended magnetic field pattern 91 close to side 83 of the element 81. This intended field can be decomposed by means of a Fourier analysis into a two-pole component (a magnetic pole on either side of the element 81) plus a four-pole component, plus a six-pole component, etc. In this example, the six-pole component will be relatively strong. The magnetization in the element 81 will comprise both a component ($M_{||}$) extending at right angles to the plane 83 and a component ($M_{\perp}$) extending along the plane.

The phase difference between the signal-current components and corresponding components in the magnetic field pattern causes the accuracy with which the magnetic field pattern is generated to be improved.

Figure 10:
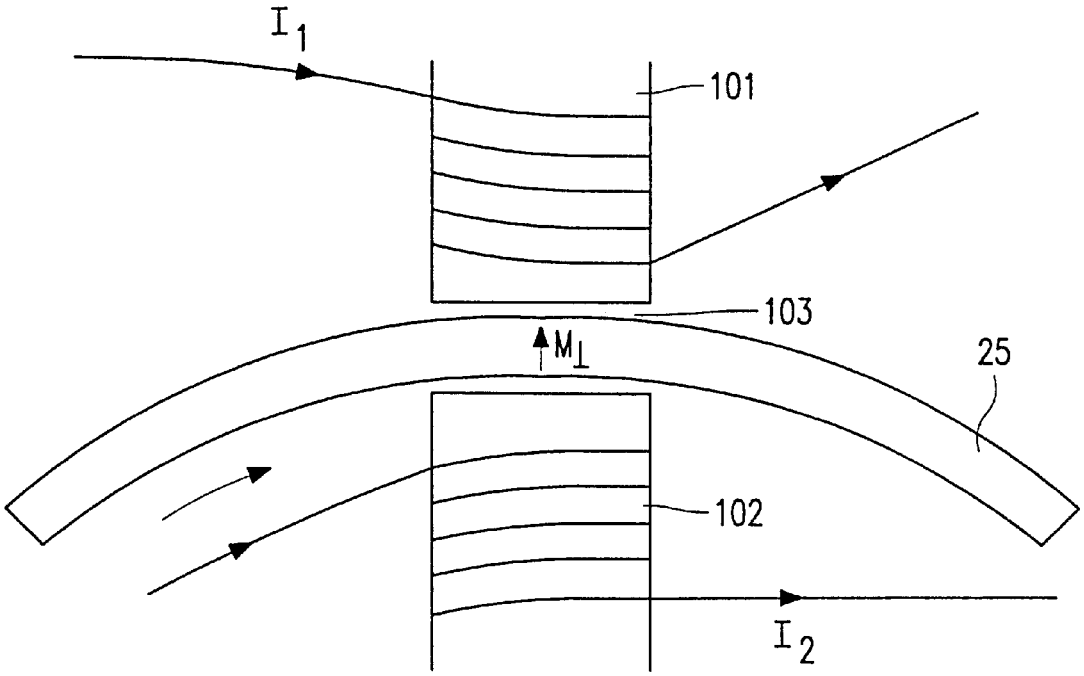
FIG. 10 illustrates an embodiment of the method in accordance with the invention.

An alternative solution to improve the accuracy is schematically shown in FIG. 10. In this Figure, the magnetizing coil system comprises two magnets 101 and 102. A gap which causes the element to move is situated between said two magnets, said gap being indicated in the Figure by an arrow. If coils 101 and 102 are energized by currents $I_1$ and $I_2$, respectively, with $I_1=-I_2$, a magnetization $M_{||}$ is generated in the element 25. In this case, the $M_{\perp}$ component is negligible. In addition, a phase difference between the signal-current components and the components of the intended field is substantially superfluous. If coils 101 and 102 are energized by currents $I_1$ and $I_2$, respectively, with $I_1=I_2$, then a magnetization $M_{\perp}$ is generated in element 25, as shown in FIG. 10. In this case, the $M_{||}$ component is negligible. Thus, a one-to-one phase difference of 90° between the signal-current components and the components of the intended field is sufficient, in a first-order approximation, to achieve a high accuracy.

It will be obvious that within the scope of the invention many variations are possible to those skilled in the art. For example, in the Figures, a cathode ray tube for a color display device is shown. However, the invention can also be applied to oscilloscopes, monochrome display devices, traveling wave tubes, electron microscopes, etc., and even to NMR devices.

In summary, in the invention, an element of an apparatus is magnetized so as to generate a magnetic field pattern around said element.

To achieve this, use is made of a magnetizing coil and the element and the magnetizing coil are moved relative to each other, said magnetizing coil carrying an alternating current of substantially constant amplitude as well as a signal current.

Preferably, there is a phase difference between one or more components of the signal current and corresponding components of an intended magnetic field pattern, i.e. such a component of the signal current slightly leads or lags a corresponding component of the intended magnetic field pattern.

We claim:

1. A method of manufacturing a device comprising an element of a hard-magnetic material, which method includes a step in which the element is magnetized by means of one or more magnetizing coils to generate a magnetic field pattern, characterized in that the magnetizing coil(s) and the element move relative to each other during magnetization of the element, while an alternating current of substantially constant amplitude as well as a signal current are passed through the magnetizing coil(s).

2. A method as claimed in claim 1, characterized in that the device is a cathode ray tube comprising a means for generating an electron beam, said electron beam moving through the magnetic field pattern, during operation.

3. A method as claimed in claim 2, characterized in that the cathode ray tube comprises a means for deflecting the electron beam, and, in operation, the position of the electron beam in the magnetic field pattern is governed by the deflection of the electron beam.

4. A method as claimed in claim 1 or 2, characterized in that the amplitude of the alternating current decreases during a last part of the magnetizing operation, while the movement of the coil system and the element relative to each other is continued.

5. A method as claimed in claim 1, characterized in that the relative movement is carried out in such a manner that at least a part of the element is magnetized twice in one movement.

6. A method as claimed in claim 1, characterized in that the signal current comprises components corresponding to components in an intended magnetic field pattern, the components of the signal current exhibiting a phase difference with respect to the corresponding components of the intended magnetic field pattern.

7. A method as claimed in claim 1, characterized in that the magnetizing coil system comprises two magnets, a gap causing the element to move being situated between said two magnets.

* * * * *